US006799559B2

(12) United States Patent
Mieny et al.

(10) Patent No.: US 6,799,559 B2
(45) Date of Patent: Oct. 5, 2004

(54) METHOD AND APPARATUS FOR CONTROLLING A DUAL COIL FUEL INJECTOR

(75) Inventors: Harry R. Mieny, Byron, NY (US); Eugene A. Kobos, Henrietta, NY (US); Gordon Cheever, Jr., Peru, IN (US)

(73) Assignee: Delphi Technologies, Inc., Troy, MI (US)

( * ) Notice: Subject to any disclaimer, the term of this patent is extended or adjusted under 35 U.S.C. 154(b) by 236 days.

(21) Appl. No.: 10/233,124

(22) Filed: Aug. 30, 2002

(65) Prior Publication Data

US 2004/0040544 A1 Mar. 4, 2004

(51) Int. Cl.[7] ..... F02D 41/34

(52) U.S. Cl. ..... 123/490; 251/129.1; 239/585.1; 701/103

(58) Field of Search ..... 123/490, 90.11, 123/568.21, 339.14; 251/129.09, 129.1, 129.15, 129.16, 129–22; 361/152, 153, 154; 239/5, 533.2, 585.1, 585.2, 585.3, 585.4, 585.5; 137/62, 831; 701/101, 102, 103, 104, 105

(56) References Cited

U.S. PATENT DOCUMENTS

| | | | | | |
|---|---|---|---|---|---|
| 4,583,710 | A | * | 4/1986 | Adams et al. | 251/129.1 |
| 4,730,637 | A | * | 3/1988 | White | 137/62 |
| 6,036,120 | A | * | 3/2000 | Varble et al. | 239/585.1 |
| 6,065,684 | A | * | 5/2000 | Varble et al. | 239/5 |
| 6,202,608 | B1 | * | 3/2001 | Yamaki et al. | 123/90.11 |
| 6,273,067 | B1 | | 8/2001 | Bazinet | 123/458 |
| 6,321,735 | B2 | | 11/2001 | Grieve et al. | 123/674 |
| 6,345,606 | B1 | | 2/2002 | Ricci-Ottati et al. | 123/456 |
| 6,392,865 | B1 | * | 5/2002 | Fochtman et al. | 251/129.1 |
| 6,546,916 | B2 | | 4/2003 | Hopley | 123/502 |
| 6,578,555 | B2 | | 6/2003 | Sykes | 123/479 |
| 6,681,728 | B2 | * | 1/2004 | Haghgooie et al. | 123/90.11 |
| 6,729,278 | B2 | * | 5/2004 | Hammoud | 123/90.11 |
| 6,732,959 | B2 | * | 5/2004 | Delaney et al. | 239/585.1 |
| 2004/0040544 | A1 | * | 3/2004 | Mieny et al. | 123/490 |

FOREIGN PATENT DOCUMENTS

| | | | | |
|---|---|---|---|---|
| JP | 2000265920 A | * | 9/2000 | 251/129.1 |
| JP | 2001032740 A | * | 2/2001 | 251/129.1 |

* cited by examiner

*Primary Examiner*—Wilis R. Wolfe
(74) *Attorney, Agent, or Firm*—Patrick M. Griffin

(57) ABSTRACT

A method for controlling a dual coil fuel injector having an opening coil and a closing coil includes issuing an opening coil pulse to the opening coil. The opening coil pulse has an opening coil pulse width (OCPW) and an opening coil turn on time (OCTOT). A closing coil turn on time (CCTOT) is calculated dependent at least in part upon the OCPW. A closing coil pulse is issued to the closing coil at the calculated CCTOT.

25 Claims, 7 Drawing Sheets

150

| Opening Coil Pulsewidth (mS) | Delay of CCTOT Relative to OCTOT (mS) | Resulting Overlap (mS) |
|---|---|---|
| 0.4 | 0.27 | 0.13 |
| 0.45 | 0.27 | 0.18 |
| 0.5 | 0.30 | 0.20 |
| 0.6 | 0.37 | 0.23 |
| 0.7 | 0.45 | 0.25 |
| 0.8 | 0.55 | 0.25 |
| 0.9 | 0.65 | 0.25 |
| 1.0 | 0.75 | 0.25 |
| 1.1 | 0.85 | 0.25 |
| 1.2 | 0.95 | 0.25 |
| 1.3 | 1.05 | 0.25 |
| 1.4 | 1.15 | 0.25 |
| 1.5 | 1.25 | 0.25 |

Closing Coil Turn On Time Look Up Table

FIG. 5

METHOD AND APPARATUS FOR CONTROLLING A DUAL COIL FUEL INJECTOR

TECHNICAL FIELD

The present invention relates to fuel injectors and, more particularly, to a method and apparatus for controlling a dual coil fuel injector.

BACKGROUND OF THE INVENTION

Dual coil fuel injectors typically include a first coil for opening the injector valve and a second coil for closing the valve. The first or opening coil acts to open the valve against the force of a return spring, and the second or closing coil acts to close the valve when the opening coil is de-energized. The force of the closing coil is a predetermined amount less in magnitude than, and is therefore insufficient to overcome the force of, the opening coil. The closing coil can therefore be energized before the opening coil is de-energized in order to more fully develop the magnetic force of the closing coil prior to de-energizing the opening coil, thereby facilitating relatively rapid closing of the valve.

The coils are energized by the application thereto of respective electrical signals or pulses. The duration or width of the pulse applied to the closing coil, i.e., the closing coil pulse, is generally fixed. The duration or width of the pulse applied to the opening coil, i.e., the opening coil pulse, is varied dependent upon various engine operating parameters, such as, for example, engine speed and load. By varying the duration of the opening coil pulse, the fuel injector valve is held open for a period of time sufficient to ensure the required amount of fuel is injected for a particular set of engine operating conditions. As stated above, the closing coil may be energized a predetermined amount of time prior to the de-energizing of the opening coil to facilitate more rapid valve closing. Therefore, the pulses provided to the opening and closing coils "overlap" by approximately that predetermined amount of time, which is referred to hereinafter as the overlap. Generally, the overlap period is fixed, i.e., the same overlap period is applied to all injector events regardless of the duration or width of the opening coil pulse.

Applying a pulse to the closing coil that has a fixed overlap period relative to the opening pulse has certain undesirable consequences. As the width or duration of the opening pulse decreases the fixed overlap period constitutes a greater portion of the opening pulse duration, i.e., the closing pulse is applied earlier relative to the opening pulse. Thus, as the duration of the opening pulse decreases the relative overlap of the opening and closing coil pulses increases. As the duration of the opening pulse approaches the fixed overlap period, the valve may not have adequate time to fully open before the closing pulse is received and the closing coil energized. Energizing the closing coil before the injector valve is fully opened can result in the amount of fuel injected being less than desired for a given opening coil pulse duration. Further, there is a delay in time between the application of the opening pulse and the actual opening of the injector valve. This delay in valve or injector response is generally fixed and further restricts the lower limit of the opening pulse duration in order avoid injecting less fuel than desired.

The undesirable consequences of applying a fixed duration overlap are shown in the dashed FIXED OVERLAP line of FIG. 1, which illustrates that the fuel flow through the fuel injector "tails off lean" (i.e., fuel flow decreases in a generally exponential manner as the pulse width applied to the opening coil decreases) at "low end" operating conditions, i.e., opening coil pulses having relatively small pulsewidths of, for example, less than 0.9 milliseconds (mS). Thus, substantially less than the desired amount of fuel is injected when a fixed overlap is applied to the coils under these low-end operating conditions. Injecting less fuel than intended at low-end operating conditions can result in reduced engine power and/or rough engine operation.

Therefore, what is needed in the art is a method and apparatus for controlling a dual coil fuel injector that achieves improved flow performance from the fuel injector.

Furthermore, what is needed in the art is a method and apparatus for varying the overlap between the opening and closing pulses applied to a dual coil fuel injector.

Moreover, what is needed in the art is a method and apparatus that enables improved control over the amount of fuel injected at low-end operating conditions (i.e., shorter duration pulses being applied to the opening coil).

SUMMARY OF THE INVENTION

The present invention provides an apparatus and method for controlling a dual coil fuel injector.

The present invention comprises, in one form thereof, a method that includes issuing an opening coil pulse to the opening coil. The opening coil pulse has an opening coil pulse width (OCPW) and an opening coil turn on time (OCTOT). A closing coil turn on time (CCTOT) is calculated dependent at least in part upon the OCPW. A closing coil pulse is issued to the closing coil at the calculated CCTOT.

An advantage of the present invention is that the CCTOT is delayed relative to the OCTOT, thereby reducing the pulse overlap and achieving improved performance of the fuel injector.

Another advantage of the present invention is that the overlap between the opening and closing coil pulses is variable, thereby allowing the valve of the fuel injector to more fully respond to the opening coil pulse and prevent premature pinch off of fuel flow.

A further advantage of the present invention is improved control over the amount of fuel injected at low-end operating conditions.

BRIEF DESCRIPTION OF THE DRAWINGS

The present invention will now be described, by way of example, with reference to the accompanying drawings, in which:

FIG. 5 illustrates an exemplary closing coil turn on time look up table of the method and apparatus for controlling a dual coil fuel injector of the present invention;

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 2:
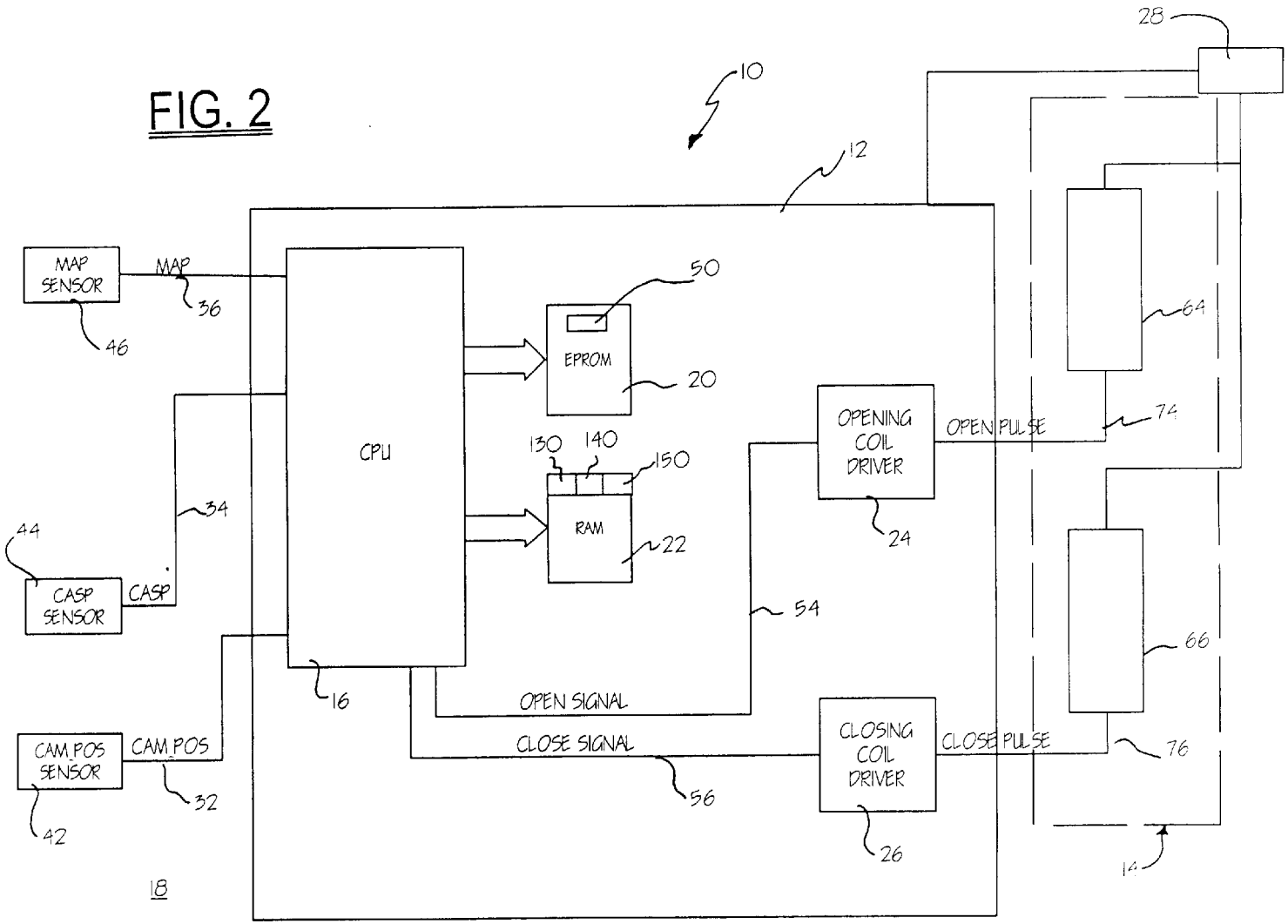
FIG. 2 is a schematic diagram of one embodiment of a dual coil fuel injection control system of the present invention.

Referring to the drawings, and particularly to FIG. 2, there is shown one embodiment of an apparatus for controlling a dual coil fuel injector of the present invention. Dual coil fuel injector control system (DCFICS) 10 includes engine control module (ECM) 12 and fuel injector 14, each of which in use are associated with engine 18.

ECM 12 is a conventional engine control computer that generally includes erasable programmable read only memory (EPROM), random access memory (RAM), at least one central processing unit, and various interface circuitry, such as, for example, input and output buffers. Generally, ECM 12 supplies opening and closing current pulses to fuel injector 14, and varies the overlap of the opening and closing pulses dependent at least in part upon the operating conditions, such as, for example, engine operating speed, of engine 18.

More particularly, ECM 12 includes central processing unit (CPU) 16, memory 20, memory 22, opening coil driver 24 and closing coil driver 26. ECM 12 is electrically connected to and powered by voltage or power source 28, such as, for example, an automobile battery (not shown). CPU 16 of ECM 12 is electrically connected to and receives cam position (CAM_POS) signal 32 from cam position (CAM_POS) sensor 42, crank position (CASP) signal 34 from crank position (CASP) sensor 44, and manifold air pressure (MAP) signal 36 from manifold air pressure (MAP) sensor 46.

Memory 20, such as, for example, an erasable programmable read only memory (EPROM) is electrically interconnected to and/or integral with CPU 16. Memory 22, such as, for example, a random access memory, is electrically interconnected to and/or integral with CPU 16. Each of memories 20 and 22 store data that is accessed by CPU 16, with CPU 16 able to write data to RAM memory 22. More particularly, memory 20 stores application software 50 that, as will be more particularly described hereinafter, is executed by CPU 16 and controls the operation of opening and closing coil drivers 24 and 26, respectively, thereby controlling the actuation of fuel injector 14. Memory 20 also stores various look up tables and other data accessed by CPU 16 and used by application software 50 to control the operation of opening and closing coil drivers 24 and 26, thereby controlling the actuation of fuel injector 14.

The circuits for opening and closing coil drivers 24 and 26 are substantially similar. Opening and closing coil drivers 24 and 26 are electrically connected to CPU 16 and receive therefrom open signal 54 and closing signal 56, respectively. The circuits for opening and closing coil drivers 24 and 26 are configured as, for example, transistor output signal drivers or buffers. Opening and closing coil driver circuits are also electrically connected to fuel injector 14, as will be more particularly described hereinafter.

Fuel injector 14 is a dual coil fuel injector, and includes opening coil 64 and closing coil 66. Opening coil 64 receives from opening coil driver 24 opening coil pulse 74, which is a buffered version of open signal 54 issued by CPU 16. Similarly, closing coil 66 receives from closing coil driver 26 closing coil pulse 76, which is a buffered version of closing signal 56 issued by CPU 16. Generally, in response to opening coil pulse 74 fuel injector 14 opens a valve member (not shown) thereby allowing a high pressure fuel to be forced out through a nozzle (not shown) thereof. Conversely, and still generally, in response to closing coil pulse 76 fuel injector 14 closes the valve member and thereby seals the nozzle preventing fuel from flowing therethrough. One exemplary embodiment of such a dual-coil fuel injector is described in U.S. Pat. No. 6,036,120, the disclosure of which is incorporated herein by reference.

As stated above, application software 50 resides in memory 20 and is executed by CPU 16 to control the operation of opening and closing coil drivers 24 and 26, respectively, thereby controlling the actuation of fuel injector 14. Generally, application software 50 varies the overlap between opening coil pulse 74 and closing coil pulse 76 dependent at least in part upon CAM_POS signal 32, CASP signal 34, and MAP signal 36. CAM_POS signal 32 is indicative of the angular position of the camshaft (not shown), CASP signal 34 is indicative of the rotational speed and position of the crank (not shown), and MAP sensor 36 is indicative of the air pressure within the manifold (not shown) of engine 18. Thus, application software 50 varies the overlap between opening coil pulse 74 and closing coil pulse 76 dependent at least in part upon the rotational speed and angular position of the crank, and the air pressure within the manifold (not shown), of engine 18.

Figure 3:
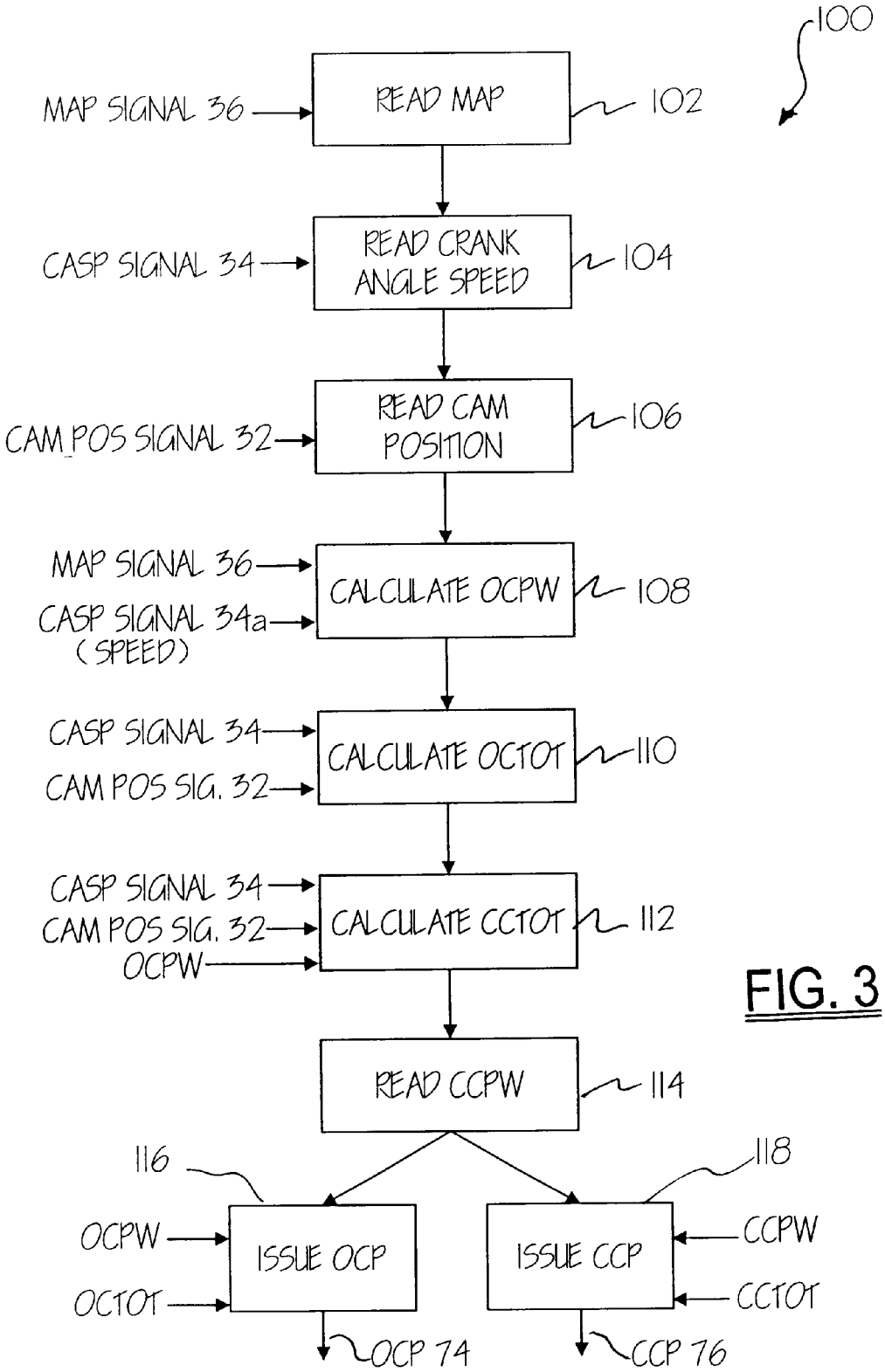
FIG. 3 is a diagram illustrating one embodiment of the method for controlling a dual coil fuel injector of the present invention.

Referring now to FIG. 3, the process steps of one embodiment of the method of controlling a dual coil fuel injector of the present invention are shown. Method 100 is performed by ECM 12 executing application software 50. Method 100 includes the steps of reading manifold air pressure 102, reading crank angle speed and position 104, reading cam position 106, calculating opening coil pulse width (OCPW) 108, calculating opening coil turn on time (OCTOT) 110, calculating closing coil turn on time (CCTOT) 112, reading closing coil pulse width (CCPW) 114, issuing OCP 116 and issuing CCP step 118.

Reading manifold air pressure (MAP) step 102 determines the air pressure within the manifold (not shown) of engine 18. More particularly, reading MAP step 102 is performed by CPU 16 executing application software 50 and reading MAP signal 36 from MAP sensor 46. Similarly, reading crank angle speed and position (CASP) step 104 includes CPU 16 reading CASP signal 34 from CASP sensor 44. Still similarly, reading cam position step 106 includes CPU 16 reading CAM_POS signal 32 from CAM_POS sensor 42. CAM_POS signal 32, CASP signal 34, and MAP signal 36 are indicative of the angular position of the cam (not shown), the rotational speed and angular position of the crank (not shown), and the air pressure within the manifold (not shown), respectively, of engine 18.

The signals from CAM_POS sensor 42 and CASP sensor 44 enable CPU 16 to calculate the speed and determine the angular position of the camshaft, and thereby determine which portion of the combustion cycle in which the engine is operating. The values read by CPU 16 from CAM_POS sensor 42, CASP sensor 44 and MAP sensor 46 are stored internally or externally of CPU 16, such as, for example, in respective internal registers (not shown) of CPU 16 or in respective cells of memory 22.

Calculate OCPW step 108 determines the opening coil pulse width, i.e., the pulse width of open signal 54 and, thus, the pulse width of opening coil pulse 74 that is applied to opening coil 64 of fuel injector 14 for a given set of engine operating parameters. More particularly, CPU 16 executing application software 50 accesses OCPW look-up table 130 (FIG. 2), which is stored in memory, such as, for example, memory 20, of ECM 12. From OCPW look-up table 130, CPU 16 retrieves a value for the pulse width or duration of opening coil pulse 74 to be applied to opening coil 64. The value that CPU 16 obtains from OCPW look-up table 130 for the duration of opening coil pulse 74 is dependent at least in part upon MAP signal 36 and CASP signal 34, which are, in turn, indicative of manifold air pressure and the rotational speed and angular position of the engine crank, respectively.

Calculate OCTOT step 110 determines the opening coil turn on time, i.e., the time at which open signal 54 and, thus, opening coil pulse 74 are turned on or become active for a given set of engine operating parameters. More particularly, CPU 16 executing application software 50 accesses OCTOT look-up table 140 (FIG. 2), which is stored in a memory, such as, for example, memory 20, of ECM 12. From OCTOT look-up table 140, CPU 16 retrieves a value for the turn on time of opening coil pulse 74. The value that CPU 16 obtains from OCTOT look-up table 140 for the turn on time of opening coil pulse 74 is dependent at least in part upon CAM_POS signal 32 and CASP signal 34, which are, as described above, indicative of the angular position of the engine camshaft and the rotational speed and angular position of the engine crank, respectively.

Issue opening coil pulse step 116 is then executed by CPU 16. CPU 16 uses the values obtained for the OCPW and the OCTOT during the execution of calculate OCPW step 108 and calculate OCTOT step 110, and issues opening coil signal 54 to opening coil driver 24. Opening coil 24, in turn, buffers opening coil signal 54 and issues opening coil pulse 74 to closing coil 64 to thereby commence the opening of the valve of fuel injector 14.

The pulse width derived by calculate OCPW step 108 is used to determine the closing coil turn on time (CCTOT) in calculate CCTOT step 112. Generally, CCTOT step 112 determines the time at which closing signal 56 and, thus, closing coil pulse 76 are turned on or become active for a given set of engine operating parameters. More particularly, CPU 16 executing application software 50 accesses CCTOT look-up table 150 (FIGS. 2 and 5), which is stored in one of the memories, such as, for example, memory 20, of ECM 12. From CCTOT look-up table 150, CPU 16 retrieves a value for the turn on time of closing coil pulse 76. The value that CPU 16 obtains from CCTOT look-up table 150 for the turn on time of closing coil pulse 76 is dependent at least in part upon CAP_POS signal 32, CASP signal 34, and the duration of the OCPW as determined in calculate OCPW step 108. An exemplary look-up table 150 is included in FIG. 5.

Read CCPW step 114 provides the pulse width of closing signal 56 and, thus, of closing coil pulse 76. More particularly, CPU 16 executing application software 50 reads the CCPW from, for example, one or more internal registers of CPU 16 or cells of memory 20. The CCPW is a generally fixed or constant value.

Issue closing coil pulse step 118 is then executed by CPU 16. CPU 16 uses the values obtained for the CCPW and the CCTOT during the execution of calculate CCTOT step 112 and read CCPW step 114, respectively, and issues closing coil signal 56 to closing coil driver 26. Closing coil driver 26, in turn, buffers closing coil signal 56 and issues closing coil pulse 76 to closing coil 66 to thereby commence the closing of the valve of fuel injector 14.

Figure 1:
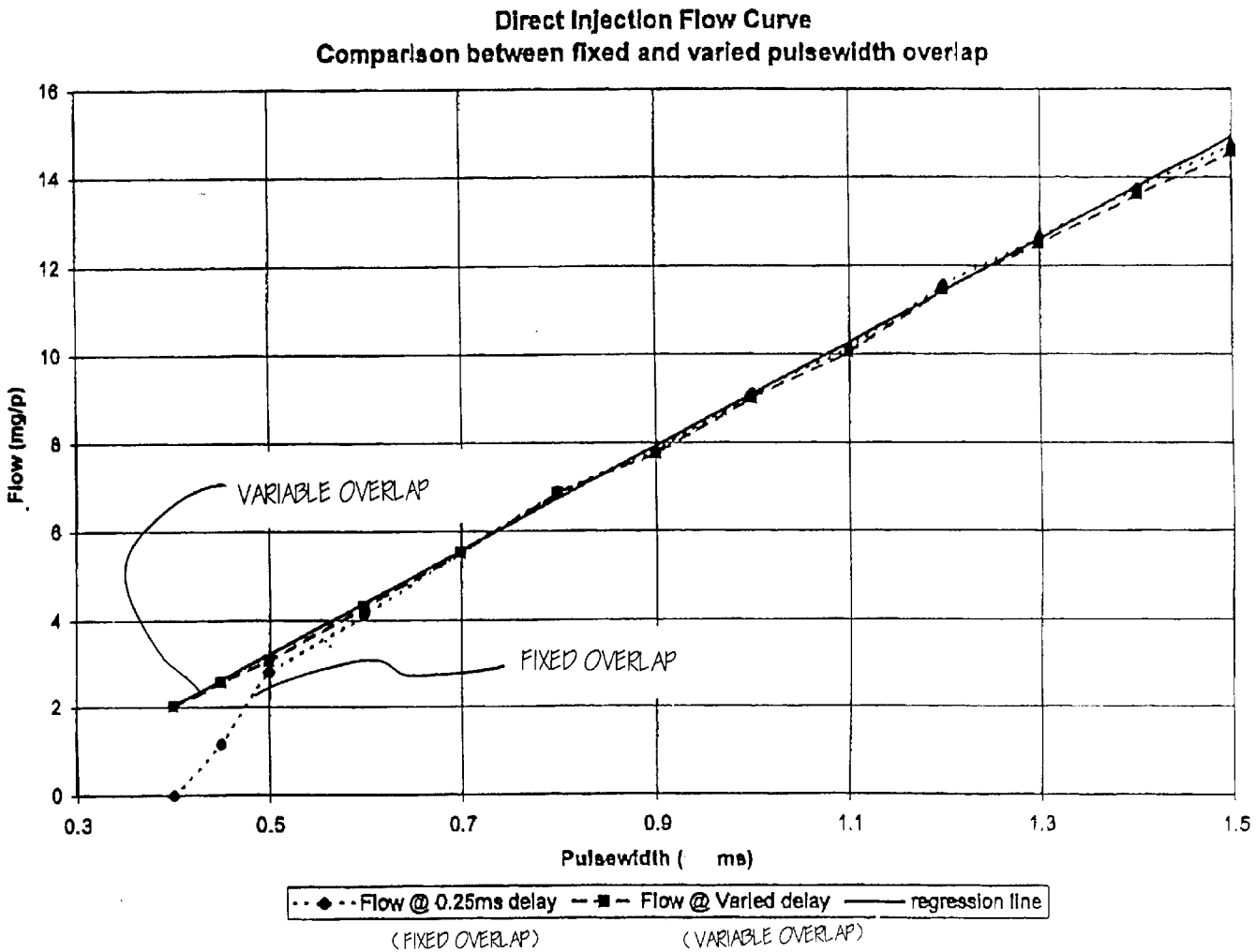
FIG. 1 is a plot of fuel flow versus opening coil pulse width for a conventional dual coil fuel injection system and for the dual coil fuel injection control system apparatus and method of the present invention.

In use, DCFICS 10 and method 100 provide improved linearity in the flow of fuel through injector 14 for short pulse widths applied to opening and closing coils 64 and 66. More particularly, DCFICS 10 and method 100 improve the linearity in the flow of fuel through injector 14 by reducing the overlap between opening coil pulse 74 and closing coil pulse 76 at "low end" pulse widths, such as, for example, pulse widths of less than approximately 0.9 milliseconds (mS). The overlap is reduced by delaying the CCTOT relative to the OCTOT. The improvement thereby achieved in the linearity of fuel flow through injector 14 is shown in FIG. 1, which plots the fuel flow versus pulsewidth for both a conventional fuel injector operating under conventional control methods and with a fixed overlap (dashed line labeled FIXED OVERLAP) and the fuel flow through fuel injector 14 controlled by DCFICS and operating according to method 100 (solid line labeled VARIABLE OVERLAP). As shown in FIG. 1, the fuel flow through injector 14 having a variable overlap (solid line) is substantially improved, i.e., much more linear, at the low end of operation and is substantially linear across virtually the entire range of pulse widths.

A conventional dual coil fuel injection system applies, as stated above, a fixed overlap between the opening and closing coil pulses. The fixed overlap, typically having a duration of approximately 0.25 mS, causes the amount of fuel injected to decrease or tail off lean at the low end of the flow curve (i.e., for short duration pulsewidths applied to the opening coil). This is due at least in part to the mechanical response time required for the fuel injector to respond (i.e., open) to the opening coil pulse. The mechanical response time of a typical fuel injector is approximately 0.4 milliseconds. When the opening coil pulse width is relatively short, such as, for example, less than approximately 0.9 mS, and a fixed overlap is applied, the closing coil may be energized before the injector valve has had time to fully open. Thus, fuel flow through the injector may be prematurely pinched off or tail off lean.

As an example, a conventional dual coil fuel injection system issuing an opening coil pulse having a pulsewidth of 0.4 mS and applying a fixed overlap of, for example, 0.25 mS, would activate the closing coil pulse at approximately a mere 0.15 mS after the opening coil pulse was is issued. Due to mechanical reaction time, the valve of the fuel injector in such a conventional dual coil fuel injection system may still be in the process of opening when the closing coil pulse is applied. Thus, the fuel flow through the injector valve is likely to be prematurely pinched off or tail off lean.

In contrast, DCFICS 10 and method 100 apply a variable overlap between the opening and closing coil pulses in order to reduce the overlap for low end injection events. More particularly, the CCTOT of closing coil pulse 76 is dependent at least in part upon the pulsewidth of opening coil pulse 74. For example, as shown in FIG. 5, when an opening coil pulse 74 having a pulsewidth of approximately 0.4 mS is applied to opening coil 64 the corresponding CCTOT is approximately 0.27 mS after the OCTOT, i.e., closing coil 66 is energized approximately 0.27 mS after opening coil 66 is energized thereby resulting in an overlap of 0.13 mS between opening coil pulse 74 and closing coil pulse 76. Thus, DCFICS 10 and method 100 delay the CCTOT of closing coil pulse 76 and reduce the overlap relative to a conventional dual coil injection system applying a fixed overlap, thereby permitting a longer period of time for the valve of fuel injector 14 to respond to the energizing of opening coil 64. Therefore, the valve of fuel injector 14 opens more fully and the premature pinching off of the fuel flow therethrough is substantially reduced relative to a conventional dual coil fuel injection system.

Figure 4:
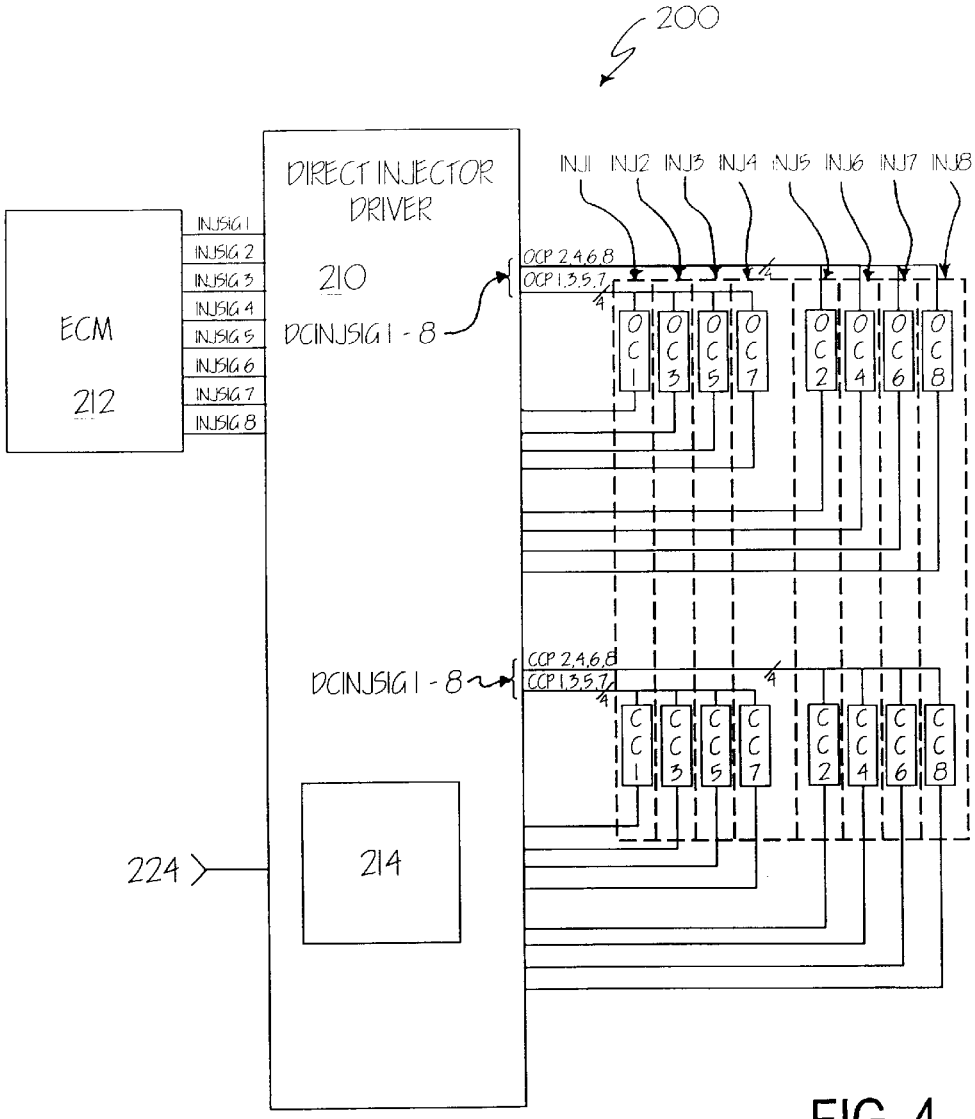
FIG. 4 is a schematic diagram of a second embodiment of a dual coil fuel injection control system of the present invention.

Referring now to FIG. 4, a second embodiment of a DCFICS is shown. DCFICS 200 includes direct injector driver (DID) circuit 210, ECM 212, application software 214 executed by DID circuit 210, and dual coil fuel injectors INJ1, INJ2, INJ3, INJ4, INJ5, INJ6, INJ7 and INJ8, each of which include pairs of opening and closing coils OC1 and CC1, OC2 and CC2, OC3 and CC3, OC4 and CC4, OC5 and CC5, OC6 and CC6, OC7 and CC7, and OC8 and CC8, respectively. Generally, DID circuit 210 executing application software 214 interfaces ECM 212 with and provides a variable duration overlap between the opening and closing coil pulses applied to dual coil fuel injectors INJ1–INJ8.

DID circuit 210 receives injector drive signals INJSIG1, INJSIG2, INJSIG3, INJSIG4, INJSIG5, INJSIG6, INJSIG7 and INJSIG8 from ECM 212. Injector drive signals INJSIGS1–8 are conventional drive signals for use in actuating or driving conventional single-coil fuel injectors. DID circuit 210 also receives fuel rail pressure (FRP) signal 224, which is indicative of fuel pressure within the fuel rails (not shown) of engine 18. DID circuit 210 includes drive circuitry (not shown) that issues dual coil injector drive signals DCINJSIGS1–8 dependent at least in part upon the corresponding conventional injector drive signals INJSIG1–INJSIG8 and FRP signal 224. DCINJSIGS1–8 include respective opening coil pulses OCP1, OCP2, OCP3, OCP4, OCP5, OCP6, OCP7 and OCP8, and respective closing coil pulses CCP1, CCP2, CCP3, CCP4, CCP5, CCP6, CCP7 and CCP8 that are applied to the opening and closing coils OC1–8 and CC1–8, respectively, of injectors INJ1–8.

The drive circuitry of DID circuit 210 is divided into odd and even sections, i.e., DCINJSIG1, 3, 5 and 7 form the odd section and DCINJSIG 2, 4, 6 and 8 in the even group, thereby enabling overlap in the actuation of consecutive injectors, e.g., injectors INJ1 and INJ2, if and when desired. The odd section issues the opening and closing coil pulses for the odd-numbered injectors INJ1, 3, 5 and 7 whereas the even section issues the opening and closing coil pulses for the even-numbered injectors INJ2, 4, 6 and 8.

DID circuit 210 is configured as a microprocessor integrated circuit, and executes application software 214. Application software 214, in general, converts conventional injector drive signals INJSIGS1–8 to dual coil injector signals DCINJSIGS1–8 suitable for actuating dual coil fuel injectors INJ1–8, thereby enabling conventional ECM 212 running conventional engine control software (not shown) to actuate dual coil fuel injectors INJ1–INJ8.

Figure 6:
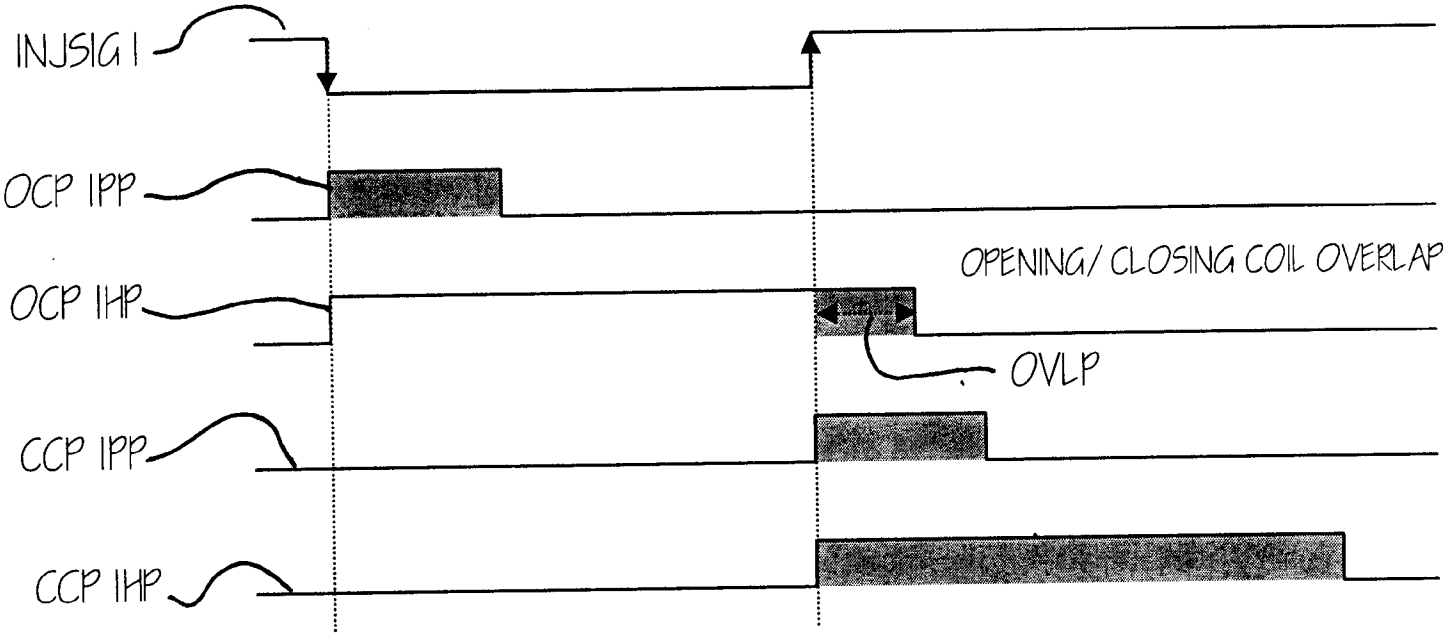
FIG. 6 illustrates an exemplary timing diagram of the opening and closing coil pulses issued by the dual coil fuel injection control system of FIG. 4.
Figure 7:
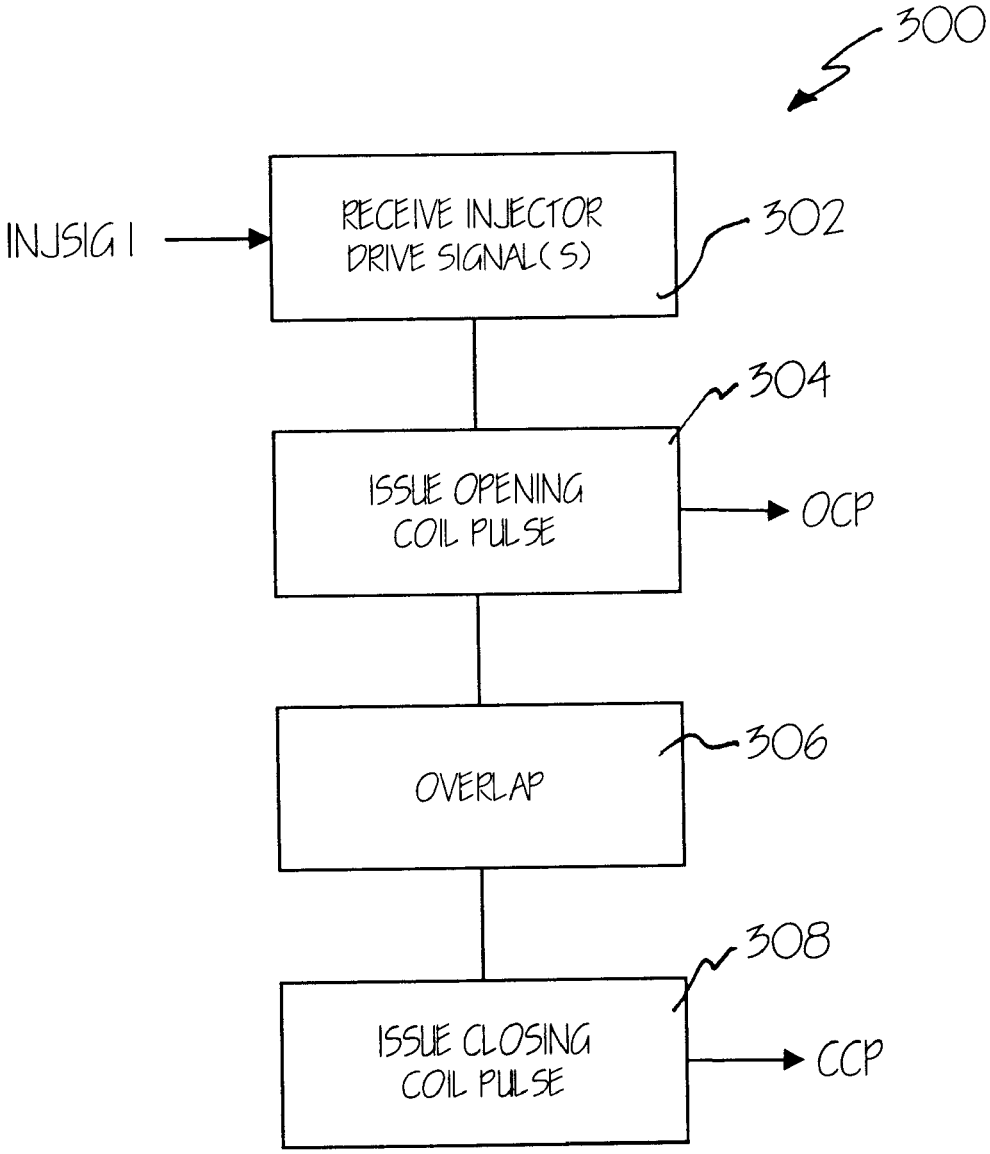
FIG. 7 is a diagram illustrating a second embodiment of the method for controlling a dual coil fuel injector of the present invention.

More particularly, application software 214 determines the pulse widths and turn on times of the opening and closing coil pulses OCP1–8 and CCP1–8, respectively, dependent at least in part upon INJSIGS1–8, FRP signal 224, and calibration values to be discussed hereinafter. With reference to FIG. 6, which shows a timing diagram of an exemplary injector input signal and the resultant opening and closing coil pulses, and FIG. 7, which shows the process steps executed by application software 214, a second embodiment of a method of the present invention is shown and described.

Method 300 is performed by DID circuit 210 executing application software 214, and includes the steps of receiving injector drive signal 302, issuing opening coil pulse 304, overlapping opening and closing coil pulses 306, and issuing closing coil pulse 308. For clarity, method 300 is discussed with reference to an exemplary one of INJSIGS1–8, the exemplary injector input signal hereinafter being referred to as INJSIG1, and the resulting opening and closing coil pulses are referred to as OCP1 and CCP1. However, it is to be understood that the method of the present invention is performed for virtually any number of injector input signals and resulting opening and closing coil pulses.

Receiving injector drive signal step 302 includes DID driver circuit 210 receiving and monitoring INJSIG1 from ECM 212. When DID driver circuit 210 and application software 214 detect a transition of INJSIG1 to an active state, such as, for example, from a high to a low logic/voltage level, DID driver circuit 210 and application software 214 execute issue opening coil pulse step 304.

Issue opening coil pulse step 304 includes issuing an active, such as, for example, a high logic/voltage level, OCP1 signal. OCP1 signal includes an opening coil peak pulse OCP1PP signal and an opening coil hold pulse OCP1HP signal. The duration of the opening coil peak pulse OCP1 PP signal is a predetermined or calibratable quantity, and is read by DID circuit 210 from, for example, a user-programmable internal register (not shown) of DID driver circuit 210 or external memory circuit (not shown). The duration of opening coil hold pulse OCP1 HP is determined at least in part by INJSIG1, and is extended by overlapping opening and closing coil pulses step 306.

Overlapping opening and closing coil pulses step 306 includes maintaining or extending the active state of opening coil hold pulse OCP1HP signal. More particularly, the duration of the active state of opening coil hold pulse OCP1HP signal is extended by a predetermined or calibratable overlap value OVLP, during which time each of OCP1HP and the closing coil pulse CCP1 are active. The value for the overlap duration OVLP is dependent at least in part upon the duration of INJSIG1, and is read by DID circuit 210 from, for example, a user-programmable internal register (not shown) of DID driver circuit 210 or external memory circuit (not shown). At the end of the predetermined overlap OVLP of the active states of opening coil hold pulse OCP1HP signal and the closing coil pulse signal CCP1, OCP1HP is returned by DID circuit 210 and application software 214 to its inactive state or level.

When DID driver circuit 210 and application software 214 detect a transition of INJSIG1 from an active state to an inactive state, such as, for example, from a low to a high logic/voltage level, DID driver circuit 210 and application software 214 execute issue closing coil pulse step 308. Issue closing coil pulse step 308 includes issuing an active, such as, for example, a high voltage level, closing coil pulse CCP1 signal. CCP1 signal includes a closing coil peak pulse CCP1PP signal and a closing coil hold pulse CCP1HP signal. The duration of the closing coil peak pulse CCP1PP signal is a predetermined or calibratable quantity, and is read by DID circuit 210 from, for example, a user-programmable internal register (not shown) of DID driver circuit 210 or external memory circuit (not shown). The duration of closing coil hold pulse CCP1HP is, similarly, a predetermined or calibratable quantity read from a user-programmable internal register of DID circuit 210 or from an external memory circuit.

By using a calibratable or user programmable value for the overlap value or duration OVLP, method 300 enables ECM 212, via DID circuit 210 and application software 214, to be interfaced with and actuate dual coil fuel injectors INJ1–INJ8 and apply thereto a variable overlap between activation of the closing coil and deactivation of the opening coil to thereby improve the linearity of fuel flow particularly for smaller duration opening coil pulses. More particularly, as the duration of the input injector signals INJSIGs1–8 decrease, the corresponding and predetermined values of OVLP decrease thereby reducing the overlap between the opening and closing coils relative to a conventional dual coil injection system applying a fixed overlap. The reduced overlap provides a longer period of time to the fuel injector valve to respond to the energizing of opening coil 64. Thus, the valve of the fuel injector opens more fully and any premature pinching off of fuel flow through the valve is thereby substantially reduced relative to a conventional dual coil fuel injection system. The reduction in overlap OVLP relative to injector input signal for method 300 is generally similar to that shown in FIG. 5.

It should be particularly noted that DCINJSIGS1–8 are applied to the "high-side" of the opening and closing coils OC1–8 and CC1–8, respectively. DCINJSIGS 1–8 are configured as, for example, chop signals or a sawtooth waveform/signal. The "lowside" of the injector coils are tied to ground potential or, alternatively, have applied thereto or receive respective enable signals (not shown) that tie the low side of the coils to ground potential.

In the embodiments shown, it should be particularly noted that consecutive odd or consecutive even injectors firings, such as, for example, injectors 1,3 and/or injectors 2, 4, must be separated by a duration of time that is greater than the duration of the overlap of the opening and closing coils, i.e., the opening coil of the first-firing injector of the consecutive odd or even pair must be deactivated prior to the activation of the opening coil of the next-firing injector of that pair. It should also be particularly noted that overlap of the closing coils between consecutive odd or consecutive even injector pairs should similarly be avoided.

In the first embodiment shown, the CCTOT is delayed relative to the OCTOT to enable the valve of the fuel injector to respond to the energizing of the opening coil, and exemplary values of the delay of the CCTOT relative to the OCTOT for a range of OCPW's is provided. However, it is to be understood that the present invention can be alternately configured with values of CCTOT delay relative to the OCTOT for varying ranges of OCPW's. The actual CCTOT delays and the corresponding OCPWs are application specific, and are therefore likely to vary from the exemplary values disclosed herein.

In the first embodiment shown, the CCPW is a generally constant or fixed value and is stored in an internal register or memory of the ECM. However, it is to be understood that the present invention can be alternately configured with a CCPW that varies dependent at least in part upon engine operating parameters, such as, for example, OCPW. Further, the present invention can be alternately configured to store the CCPW in a different form and/or location, such as, for example, as a look up table within a memory of ECM 12.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. A computerized method of controlling a dual coil fuel injector in an engine, the dual coil fuel injector having an opening coil and a closing coil, said method comprising the steps of:

issuing an opening coil pulse to the opening coil, the opening coil pulse having an opening coil pulse width (OCPW) and an opening coil turn on time (OCTOT);

calculating a closing coil turn on time (CCTOT) dependent at least in part upon said OCPW; and issuing at said CCTOT a closing coil pulse to the closing coil.

2. The method of claim 1, wherein said calculating a CCTOT step comprises adjusting the CCTOT relative to the OCTOT dependent at least in part upon said OCPW.

3. The method of claim 1, comprising the further step of buffering the opening coil pulse and the closing coil pulse.

4. The method of claim 1, wherein said calculating a CCTOT step comprises increasingly delaying the CCTOT relative to the OCTOT as the OCPW decreases below a predetermined value, the CCTOT being increasingly advanced as the OCPW increases toward the predetermined value.

5. The method of claim 4, wherein said predetermined value is approximately 0.9 milliseconds.

6. The method of claim 4, wherein said predetermined value is approximately 0.7 milliseconds.

7. The method of claim 4, wherein said calculating a CCTOT step comprises delaying the CCTOT by approximately three hundred and seventy (370) microseconds relative to the OCTOT when the OCPW is approximately 0.6 milliseconds.

8. The method of claim 7, wherein said calculating a CCTOT step further comprises delaying the CCTOT by approximately three hundred (300) microseconds relative to the OCTOT when the OCPW is approximately 0.5 milliseconds.

9. The method of claim 8, wherein said calculating a CCTOT step comprises delaying the CCTOT by approximately two hundred and seventy (270) microseconds relative to the OCTOT when the OCPW is approximately 0.45 milliseconds.

10. The method of claim 9, wherein said calculating a CCTOT step comprises delaying the CCTOT by approximately two hundred and seventy (270) microseconds relative to the OCTOT when the OCPW is approximately 0.4 milliseconds.

11. The method of claim 1, comprising the further step of calculating the opening coil pulse width (OCPW) dependent at least in part upon an air pressure within a manifold of the engine, a rotational speed of a crank of the engine, and a angular position of a camshaft of the engine.

12. The method of claim 11, comprising the further steps of sensing the air pressure within the manifold, sensing the rotational speed of the crank, and sensing the angular position of the camshaft.

13. The method of claim 11, comprising the further step of calculating the OCTOT dependent at least in part upon an angular position of the crank and the rotational speed of the crank, and the angular position of the camshaft.

14. The method of claim 13, comprising the further step of sensing the angular position of the crank.

15. The method of claim 11, comprising the further step of calculating the CCTOT dependent at least in part upon the OCPW, an angular position of the crank, and an angular position of a cam of the engine.

16. The method of claim 15, comprising the further step of sensing the angular position of the cam.

17. A system for controlling the operation of a dual coil fuel injector in an engine, the dual coil fuel injector having an opening coil and a closing coil, the engine having a manifold, crank and cam, said system comprising:

a manifold air pressure sensor, said manifold air pressure sensor sensing an air pressure within the manifold and issuing a manifold air pressure signal (MAP signal) indicative thereof;

a crank sensor, said crank sensor sensing an angular position of the crank and issuing a crank position signal (CASP signal) indicative thereof;

a cam position sensor, said cam position sensor sensing an angular position of the cam and issuing a cam position signal (CAM_POS signal) indicative thereof;

an engine control module (ECM) having a central processor and a memory, said engine control module receiving said MAP signal, said CASP signal and said CAM_POS signal, said engine control module issuing an opening coil pulse to the opening coil and a closing coil pulse to the closing coil, said opening coil pulse having an opening coil turn on time (OCTOT) and an opening coil pulsewidth (OCPW), said closing coil pulse having a closing coil pulse turn on time (CCTOT) and a closing coil pulse width (CCPW); and application software stored in said memory of and being executable by said ECM, said application software configured for calculating said CCTOT dependent at least in part upon said OCPW to adjust said CCTOT relative to said OCTOT and thereby adjust an overlap of said opening and closing coil pulses.

18. The system of claim 17, further comprising an OCPW look up table stored in said memory of said ECM, said OCPW look up table cross-referencing values of said manifold air pressure and said rotational speed of said crank to corresponding values of said OCPW, said application software instructing said central processing unit to access said OCPW look up table to obtain a value for said OCPW that corresponds to particular values of manifold air pressure and the rotational speed of said crank.

19. The system of claim 17, further comprising a CCTOT look up table stored in said memory of said ECM, said CCTOT look up table cross-referencing values of said crank angular position, said cam angular position and said OCPW, said application software instructing said central processing unit to access said CCTOT look up table to obtain a value for said CCTOT that corresponds to particular values of said crank angular position, said cam angular position and said OCPW.

20. The system of claim 17, wherein said CCTOT is increasingly delayed relative to said OCTOT as said OCPW decreases below a predetermined value, the CCTOT being increasingly advanced as the OCPW increases toward said predetermined value, thereby adjusting the overlap of said opening and closing coil pulses.

21. The system of claim 20, wherein said predetermined value is less than approximately 0.9 milliseconds.

22. The system of claim 20, wherein said predetermined value is less than approximately 0.7 milliseconds.

23. An engine control module (ECM) executing a method of controlling a dual coil fuel injector, the dual coil fuel injector having an opening coil and a closing coil, said method including the steps of:

issuing an opening coil pulse to the opening coil of the dual coil fuel injector, the opening coil pulse having an opening coil pulse width (OCPW) and an opening coil turn on time (OCTOT);

calculating a closing coil turn on time (CCTOT) dependent at least in part upon said OCPW; and issuing at said CCTOT a closing coil pulse to the closing coil of the dual coil fuel injector.

24. A motor vehicle having an engine control module and a dual coil fuel injector, said engine control module (ECM) executing a method of controlling the dual coil fuel injector, the dual coil fuel injector having an opening coil and a closing coil, said method including the steps of:

issuing an opening coil pulse to the opening coil of the dual coil fuel injector, the opening coil pulse having an opening coil pulse width (OCPW) and an opening coil turn on time (OCTOT);

calculating a closing coil turn on time (CCTOT) dependent at least in part upon said OCPW; and issuing at said CCTOT a closing coil pulse to the closing coil of the dual coil fuel injector.

25. A system for controlling the operation of a dual coil fuel injector in an engine, the dual coil fuel injector having an opening coil and a closing coil, said engine having an engine control module (ECM) issuing conventional single-coil fuel injector actuation signals, said system comprising:

a direct injection driver receiving said single-coil fuel injector actuation signal and issuing opening and closing coil pulses to opening and closing coils of said dual coil fuel injector; and application software executed by said direct injection driver, said application software determining an overlap value, said overlap value being dependent at least in part upon said single-coil fuel injector actuation signal, said overlap value determining an overlap between said opening and closing coil pulses.

* * * * *